United States Patent [19]

Brockmüller

[11] 3,943,833

[45] Mar. 16, 1976

[54] PRODUCTION OF LINED VALVED BAGS

[75] Inventor: Friedrich Franz Brockmüller, Lengerich of Westphalia, Germany

[73] Assignee: Windmoller & Holscher, Lengerich of Westphalia, Germany

[22] Filed: Sept. 17, 1974

[21] Appl. No.: 506,758

Related U.S. Application Data

[62] Division of Ser. No. 301,760, Oct. 30, 1972, abandoned.

[30] Foreign Application Priority Data

Nov. 6, 1971 Germany ..... 2155265

[52] U.S. Cl. ..... 93/35 R; 93/8 VB; 93/8 W

[51] Int. Cl.[2] ..... B31B 39/00

[58] Field of Search ..... 93/35 R, 8 R, 8 W, 14, 93/17, 18, 8 VB, 19, 20, 27, 32, 36.01

[56] References Cited

UNITED STATES PATENTS

| | | | |
|---|---|---|---|
| 3,133,480 | 5/1964 | Gerard | 93/35 R |
| 3,473,446 | 10/1969 | Berghgracht | 93/8 W X |
| 3,530,774 | 9/1970 | Booth et al. | 93/35 R |
| 3,540,356 | 11/1970 | Lecomte | 93/35 R |
| 3,724,340 | 4/1973 | Brockmüller | 93/35 R |

*Primary Examiner*—James F. Coan

*Attorney, Agent, or Firm*—Fleit & Jacobson

[57] ABSTRACT

A bag comprising an inner lining of plastics film and an outer layer of paper comprises a folded closure at least at one end. The folding of the inner lining is incorporated in the folding of the outer layer but is secured by means of separate adhesive. The inner lining and outer layer are made from respective flattened tube sections of which the inner tube section projects from the outer tube section at that end where the folded closure is to be made. During one stage in the folding of the end closure, a tongue formed in the projecting part of the inner tube section is turned over so that at this position the inner tube section is set back from the corresponding edge of the outer tube section.

2 Claims, 11 Drawing Figures

PRODUCTION OF LINED VALVED BAGS

This is a divisional application of Ser. No. 301,760 filed Oct. 30, 1972 and now abandoned.

The invention relates to a valved bag or sack (hereinafter referred to simply as a bag) having a folded base closure and comprising a single or multi-ply outer layer of paper and an internal lining made from plastics film. The invention also extends to a method of making such a bag.

In known bags of this kind, the internal lining is made as a flat bag and is closed by transverse weld seams. Although this results in an air-tight closure for the lining, the lining will lie uniformly against the outer layer only if the outer layer is also in the form of a flat bag having straight transverse closure seams. If the outer layer is furnished with a folded base closure, for example with a folded cross-bottom closure, cavities are formed between the lining and the outer layer and these cavities give rise to difficulties during filling of the bag.

More important, the formation of the internal lining as a flat bag closed by transverse weld seams prevents the incorporation of an efficient filling valve because, if the internal lining is made in accordance with German Patent Specification No. 1,802,854 or German Gebrauchsmuster Specification No. 7,043,121, it must be provided with a filling orifice in the vicinity of the filling valve by means of a suitable incision or an interruption in the transverse weld seam; this filling orifice very easily tears open during filling of the bag and then makes the filling valve useless.

The invention aims to provide a bag of the kind referred to in which the internal lining lies intimately against the outer lining even in the region of the folded closure without the formation of cavities, and in which a smooth valve tube can be incorporated as a filling vlave without the need for incisions that might weaken the bag.

According to the invention, the end of the internal lining adjacent the or each folded closure end of the bag is connected to the outer lining by means of transverse adhesive seams and is incorporated in the folded closure of the outer layer in such a way that its end projects beyond the end edges of the corner folds and the inner side flap of the outer layer and is foreshortened in the region of the outer side flaps of the outer layer by an amount which is substantially equal to the amount of overlap between these side flaps, the projecting portions of the internal lining being closed with adhesive applications of their own.

This construction of the bag permits the adhesion of a valve tube onto the corner flaps of the still-open base closure, it being possible to stick the valve tube peripherally to the base fold of the internal lining and to give the latter an airtight closure by means of adhesive seams of its own. The valve tube opens directly into the interior of the interal lining.

In production of the bags, the internal lining and the outer layer are each made from flattened tube sections. In order to avoid the need for stamping out rectangular portions from the inner tube section, the length of the stamped-out portions being equal to the length of the side flaps of the base closure and the depth being equal to the amount by which the inner tube section projects beyond the outer tube section plus the distance by which the side flaps of the outer tube section overlap, so that during formation of the base closure the internal lining will not cover the overlapping parts of the side flaps of the outer layer and therby hinder the adhesion of same to one another, it is preferred that a tongue defined on the projecting portion of the inner tube section by incisions is turned over through 180° in the region of the outer side flap of the outer layer at a distance from the end of the outer side flap corresponding to the amount of overlap of the two side flaps, the tongue then being adhered to the outer layer at the turned-over edge.

Such turning over permits the production of bags from inner and outer tube sections having straight ends by an efficient high speed process in accordance with our own German Patent Specification No. 16,11,710.5. In this high speed process, a series of plastics inner tube sections that overlap at their ends are synchronously applied to a web of paper that is destined to form the outer tube sections and that is provided with transverse perforations at intervals equal to the desired length of the outer tube sections, the inner tube sections being attached to the web so that the transverse perforations extend closely adjacent the overlapping portions of the inner tube sections, whereupon the web is closed to tube form about the inner tube sections. Subsequently, individual bag sections each consisting of an inner and an outer tube section are successively torn off along the transverse perforations and are led away for finishing the bags.

By means of the present invention, the known method for forming bags in which only one end of the inner lining is incorporated in the folded base closure of the outer layer is modified in that the inner tube sections are connected to the outer tube section both at the top and at the bottom by means of transverse lines of adhesive applied to the paper web in the region of the ends of the inner tube section that project beyond the transverse perforations, one of the lines of adhesive lying closely adjacent the transverse perforations and the other lying at a spacing therefrom that is substantially equal to the amount of overlap of the side flaps of the outer layer, and that the edge of the inner tube section is turned over through 180° about the line of adhesive that is at a spacing from the perforations, the base closure being effected after application of adhesive to the edges of the still-open base closure of the inner and outer tube sections such that the region containing the turned-over edge of the inner tube section forms the outer side flap.

To form bags in which both ends of the inner tube section are incorporated in a respective base closure, the known mehtod is modified in that the amount of overlap of the inner tube sections is equal to twice the distance by which the inner tube section is desired to project beyond the edges of the corner folds and side flaps of the outer tube section, the succession of overlapping inner tube sections is so connected to the web of outer tube sections by transverse lines of adhesive that the transverse perforations lie centrally of the overlaps. The overlying end of each inner tube section being connected to a lower face of the paper web by a line of adhesive which lies outside the region of overlap by being set back at a given spacing from the transverse perforations and being connected to an upper face of the paper web by a line of adhesive which lies within the region of overlap closely adjacent the transverse perforations whereas the underlying end of each inner tube section is connected to the lower face of the web by a line of adhseive which lies within the region of overlap closely adjacent the transverse perforations and is connected to the upper face of the web by a line of adhesive which lies outside the region of overlap by being set back at the same said given spacing from the transverse perforations, the said given spacing being substantially equal to the amount of mutual overlap of the side flaps of closure of the outer tube section. When the individual bag sections are subsequently severed along the perforations, each inner tube section will project from the outer tube section at both ends and it can be adhered to the outer tube section on the one hand closely adjacent the edge of the outer tube section and on the other hand at the said given spacing therefrom. The folded closure can therefore be formed at both ends of the tube sections in the manner described.

The invention will now be described with reference to the accompanying drawings which illustrate individual characteristic phases in the production of bags that are provided with a cross-bottom closure at one or both ends, the cross-bottom closure of the internal lining being incorporated in the cross-bottom closure of the outer layer and being provided with its own adhesive to form an air-tight seal, one of the closures of the bag being equipped with a filling valve.

Figure 1:
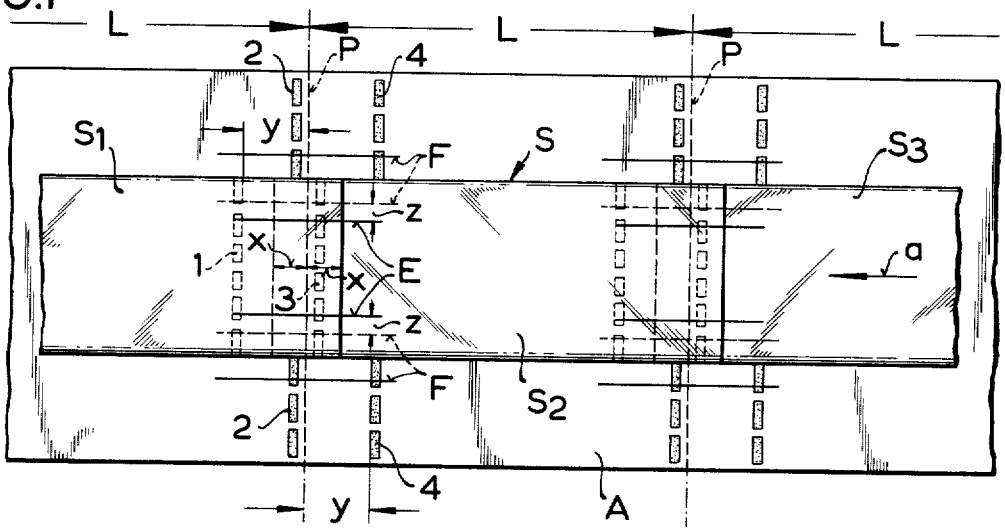
FIG. 1 is a plan view of a paper web that is destined to form the outer tube sections and, superposed on the web, a series of overlapping inner tube sections, in the formation of bag sections in which the inner tube sections project from the outer tube sections at both ends.
Figure 2:
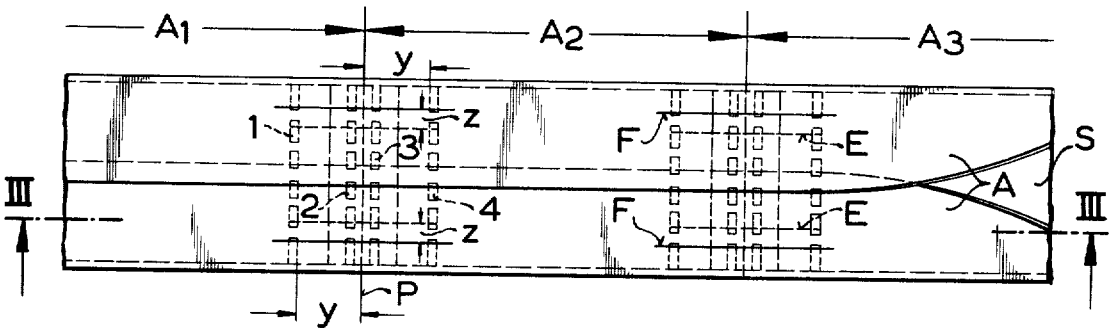
FIG. 2 illustrates the FIG. 1 arrangement after the paper web has been closed to a tube.
Figure 3:
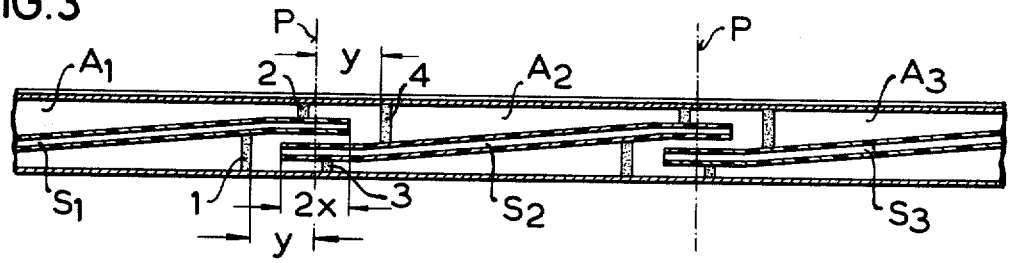
FIG. 3 is a section on the line III—III in FIG. 2.
Figure 1A:
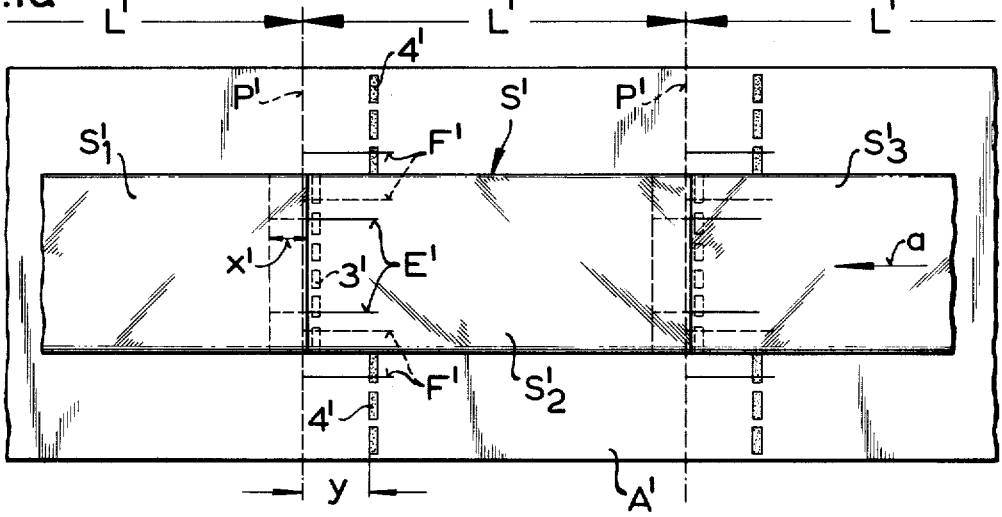
Figure 2A:
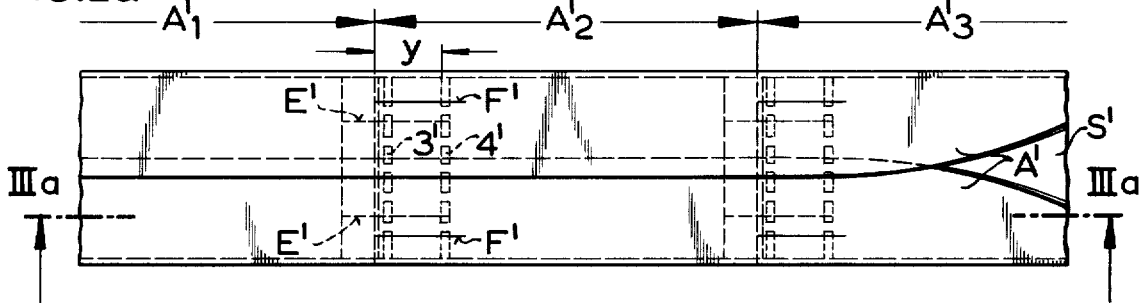
Figure 3A:
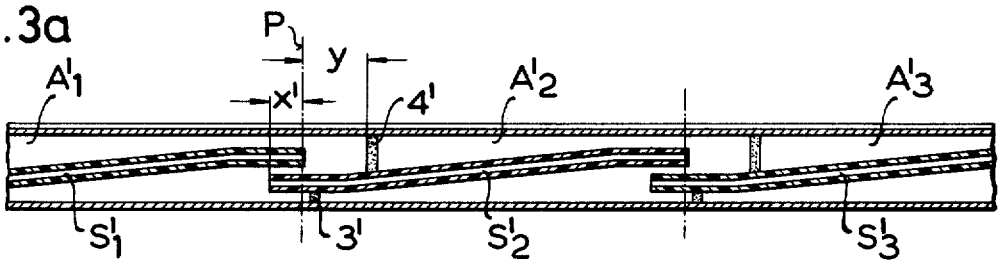

FIG 1*a* is a plan view corresponding to that of FIG. 1 but in which each bag section is to comprise an inner tube section that projects from the outer tube section at only one end;

FIG. 2*a* is a view of the FIG. 1*a* arrangement after the paper web has been closed to form a tube;

FIG. 3*a* is a longitudinal section on the line III*a*—III*a* in FIG. 2*a;*

Figure 4:
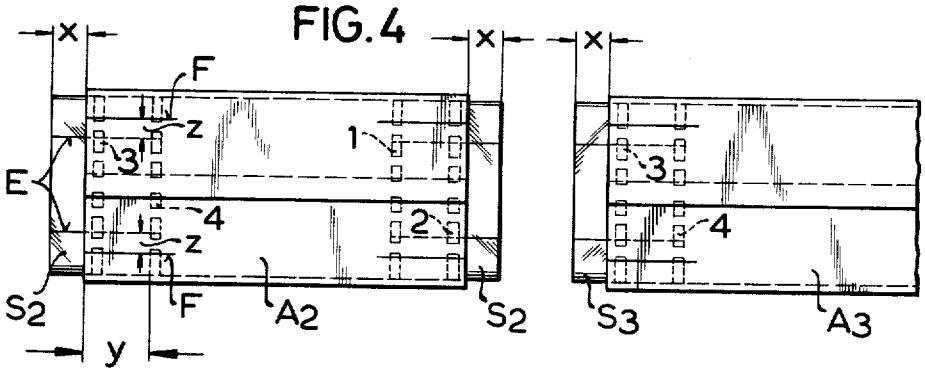
FIG. 4 shows a bag section after the outer layer has been severed from the paper web.
Figure 4A:
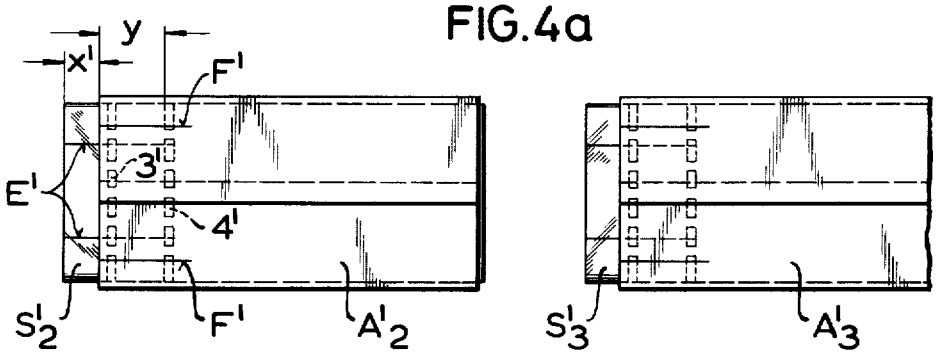

FIG. 4*a* illustrates a bag section after the outer tube section has been severed from the tubular web shown in FIG. 2*a;*

Figure 5:
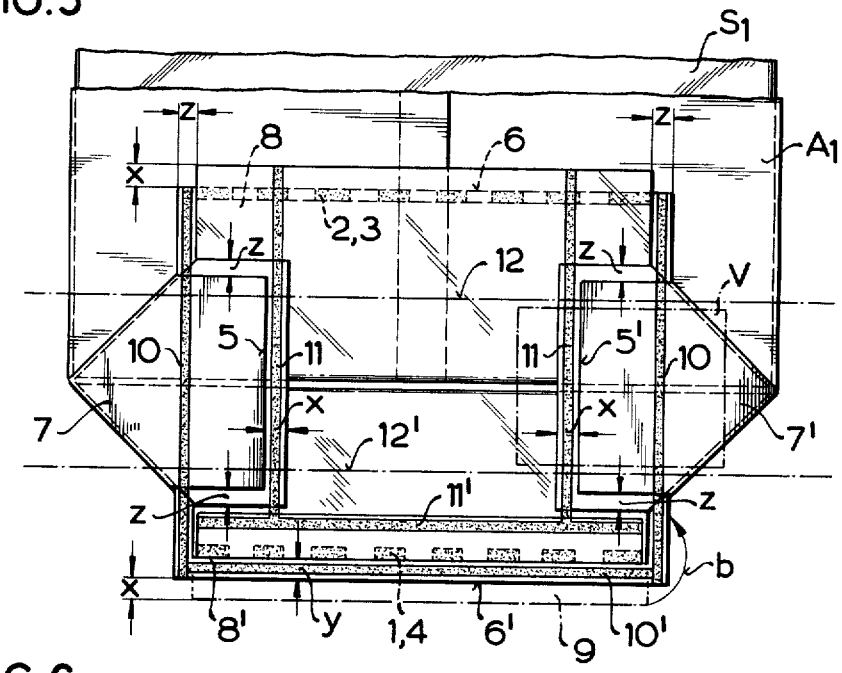
Figure 6:
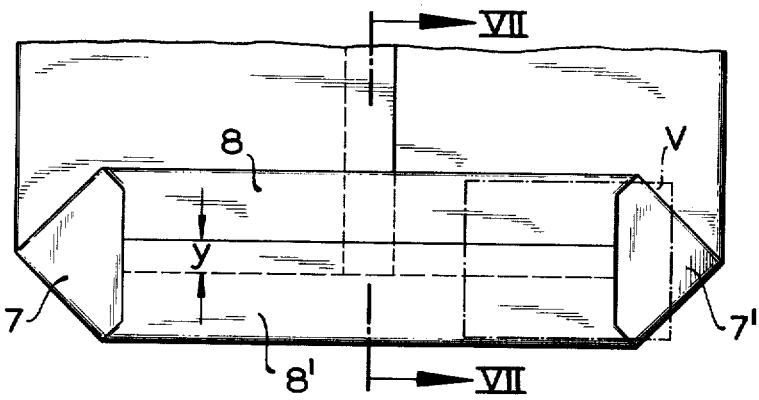
Figure 7:
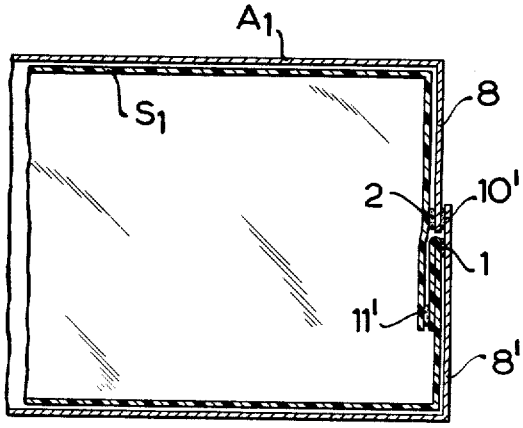

FIG. 5 is a fragmentary enlarged plan view of a bag section after one end has been opened up to form a folded cross-bottom closure of which the side flaps are still open;

FIG. 6 is a fragmentary plan view corresponding to that of FIG. 5 after the closure has been formed, and FIG. 7 is a section on the line VII-VII in FIG. 6.

In the manufacture of lined bags according to the present invention and provided with folded closures at both ends, bag sections are necessary in each of which the inner tube section projects from both ends of the outer tube section. To make such bag sections, for example in accordance with German Patent Specification No. 16,11,710.5, a series S of overlapping inner tube sections $S_1$, $S_2$ ..... made from plastics film is continuously advanced in the direction of the arrow *a* in FIG. 1 and synchronously applied to a paper web A that is also fed in the direction of the arrow *a*. At intervals corresponding to the desired length L of the outer tube sections, the web A is provided with lines of transverse perforations P. The paper web is destined to form outer tube sections $A_1$, $A_2$ ..... (see FIGS. 2 and 3). The overlap at the ends of the inner tube sections is designated 2*x* and is equal to twice the amount *x* by which each inner tube section is to project from each end of the outer tube section (see FIG. 4). The series S of inner tube sections and the web A are so superposed that the perforations P lie centrally of the overlaps at the ends of the inner tube sections, as will be readily apparent from FIGS. 1 and 3. Both the inner and outer tube sections are provided with incisions E and F, respectively, which are arranged symmetrically to the transverse perforations P and which will later define side flaps for the end closures (FIG. 5). These incisions are applied by circular rotary knives before the inner tube sections are applied to the web A. In the vicinity of each line of perforations P, four rows or lines 1, 2, 3, 4 of adhesive are applied to the paper web. it will be seen from FIG. 3 that the lines 1 and 2 of adhesive are associated with the end of an inner tube section which overlies an adjacent inner tube section whilst the lines 3 and 4 are associated with the underlying end of each inner tube section. The line 1 of adhesive connects the overlying end to a lower face of the web A after the latter has been folded around the flattened inner tube sections. The line 1 of adhesive lies outside the region of overlap by being spaced from the transverse perforations P by a distance *y*. The line 2 of adhesive connects the overlying end of each tube section to an upper face of the outer tube section and is disposed within the region of overlap closely adjacent the perforations P. For the underlying end of each inner tube section, the line 3 of adhesive lies within the region of overlap closely adjacent the perforations P and produces a connection to the lower face of the outer tube section whereas the line 4 of adhesive is spaced a distance *y* from the perforations P and effects a connection to the upper face of the outer tube section. The distance *y* by which the lines 1 and 4 of adhesive are spaced from the perforations P is substantially equal to the mutual overlap of the side flaps of each folded end closure of the outer tube section (see FIG. 5). It will be seen from FIG. 1 that the lines 2 and 4 lie to each side of the inner tube sections and do not make a connection to the inner tube sections until the web A has been folded to lie on top of the inner tube sections.

After the web A has been folded and the inner tube sections become joined to it at both faces, any suitable severing mechanism is used to tear off the leading bag section along the perforations P. No difficulty is encountered in separating the inner tube sections because they simply overlap one another. After separation, each inner tube section projects from both ends of the associated outer tube section by the amount *x*. Subsequently, each bag section is fed to a closure-forming station to form a closure such as that shown in FIGS. 5 and 6 at each end of the bag section.

By reason of the lines 1, 2, 3, 4 of adhesive, each inner tube section is readily incorporated in the folded closure. Referring to FIG. 5, the corner folds and side flaps of the closures formed in the inner tube section project beyond the edges 5, 5′; 6, 6′ of the corner folds 7, 7′ and side flaps 8, 8′ of the closure in the outer tube section. One side flap of the inner tube section thus covers the edge 6 of the side flap 8 of the closure in the outer tube section whilst the other side flap of the inner tube section is spaced by the distance *y* from the edge 6′ of the side flap 8′ of the closure in the outer tube section. During opening up of the bag section, the part 9 of the side flap of the inner tube section associated with the side flap 8' of the closure of the outer tube section is turned over through 180° about the line 1 of adhesive in the direction of the arrow *b*. In this way the side flap 8' becomes exposed along a strip having a width *y* equal to the mutual overlap *y* of the side flaps 8, 8' of the outer tube section in the finished closure. By staggering the incisions E, F in FIGS. 1, 2 and 4 by an amount *z*, the corner folds of the inner tube section wil project beyond the side edges of the corner folds 7, 7' of the outer tube sectin by the same distance *z* whereas the side flaps 8, 8' of the outer tube section project beyond the side edges of the side flaps of the inner tube section by the amonut *z*.

This construction of the folded end closure, which is still open, permits the application of strips 10, 10' and 11, 11' of adhesive to bring about a tight seal for the outer tube section and inner tube section, respectively, after the closure has been finally folded.

The side flap 8 is folded over first through 180° about a fold line 12. Thereafter the side flap 8' is folded about a fold line 12' onto the side flap 8 to overlap the latter by the distance *y*. This causes the inner tube section to be hermetically sealed by means of the strips 11, 11' of adhesive and this air-tight seal of the inner tube section is quite independent of the folding in the outer tube section that is secured by means of the adhesive strips 10, 10'.

The manner of folding as described with reference to FIGS. 5 and 6 readily permits a valve tube V to be applied before the side flaps 8, 8' are folded over. The valve tube V opens into the interior of the inner tube section and is peripherally connected to the inner tube section by means of the adhesive strips 11. The valve tube is also peripherally joined to the outer tube section by means of the adhesive strips 10 so that the inner tube section is not unduly stressed when a filling valve is inserted.

A multi-ply web of paper can be used for the outer tube sections instead of the single ply web. By laterally staggering the plies of the paper web and correspondingly staggering the transverse perforations in the individual plies lengthwise of the web, each ply can be individually secured by adhesive when the end closure is eventually formed.

In some cases it may be sufficient if only one end of each bag is formed with a folded closure. In that case the inner tube section of each bag section need project from only one end of the associated outer tube section.

To make such bag sections, for example in accordance with the teachings of German Patent Specification No. 16, 11, 710.5, a series S' of overlapping inner tube sections $S'_1$, $S'_2$ ..... of paper fed in the direction of the arrow *a* in FIG. 1*a* is synchronously applied to a paper web A' that is also fed in the direction of the arrow *a* and that is provided at intervals corresponding to the desired length L' of the outer tube sections with transverse perforations P'. The amount of overlap of the inner tube sections is *x'* and equals the distance by which one end of each inner tube section is to project from the associated outer tube section. The series of inner tube sections is so applied to the paper web A' that the perforations P' lie closely adjacent the overlapping regions of the inner tube sections. The parts of the inner tube sections projecting beyond the perforations P' are provided with incisions E' whilst the paper web is provided with incisions F' that extend up to the perforations. In the region of the transverse perforations P' there are two rows or lines 3', 4' of adhesive which are applied to the paper web A' so that the line 3' lies closely adjacent the perforations whilst the line 4' is spaced a distance *y* therefrom, this distance *y* being substantially equal to the amount by which the side flaps of the outer tube section are eventually to overlap in the finished end closure (FIG. 6). As evident from FIG. 1*a*, the line 3' of adhesive connects each inner tube section to a lower face of the outer tube section, is disposed within the region of overlap and lies closely adjacent the perforations P'. The line 4' of adhesive lies to both side of the inner tube section and does not make a connection with the inner tube section until the web has been folded about the inner tube section as shown in FIGS. 2*a* and 3*a*. When a bag section is now severed, the inner tube section will project from only one end of the outer tube section and at this end a folded closure is then formed and secured with adhesive in the same way as described with refrence to FIGS. 5 and 6.

I claim:

1. A method of making a bag of the type comprising a single or multiply outer tube section of paper and a plastics inner tube section having at at least one end of said inner tube section a folded cross-bottom closure which is incorporated in a folded cross-bottom closure at the corresponding end of said outer tube section and in which the folded closure at only one end of the inner tube section is incorporated in the folded closure of the outer tube section, comprising the steps of synchronously applying a succession of overlapping flattened plastics inner tube sections to a paper web, which has transverse perforations at intervals equal to the intended length of the outer tube sections, in an arrangement such that the transverse perforations extend closely adjacent the overlapping portions of the inner tube sections, folding the web around the inner tube sections to form flattened outer tube sections, and severing from the web along the transverse perforations successive flattened bag sections each comprising one outer tube section and one inner tube section that projects from the outer tube section with one end, the ends of the inner tube sections that project beyond the transverse perforations are connected at both faces to the outer tube section by adhesive applied to the latter along two lines, one line of adhesive being closely adjacent the perforations and the other being set back from the perforations at a spacing substantially equal to the mutual overlap of the side flaps of the closure of the outer tube section, and wherein, during opening of the outer tube section for the purpose of forming the folded closure, a tongue defined on the projecting portion of the inner tube section by incisions is turned over through 180° along the set-back line of adhesive in the region of the side flap that is folded over first, further adhesive is applied to the margins of the still open closure folds of the inner and outer tuber sections, and the closures are then made in a manner such that the region containing the turned-over tongue is folded over last of all.

2. A method of making a bag of the type comprising a single or multiply outer tube section of paper and a plastics inner tube section having at at least one end of said inner tube section a folded cross-bottom closure which is incorporated in a folded cross-bottom closure at the corresponding end of said uter tube section and in which folded closures at both ends of the inner tube sections are incorporated in the folded closures of the outer tube sections, comprising the steps of synchronously applying a succession of overlapping flattend plastic inner tube sections to a paper web, which has transverse perforations at intervals equal to the intended length of the outer tube sections, in an arrangement such that one end of each inner tube section underlies the end of one adjacent inner tube section and the outer end overlies the end of another adjacent inner tube section, folding the web around the succession of inner tube sections to form flattened outer tube sections, and severing from the web along the transverse perforations successive flattened bag sections each comprising one outer tube section and one inner tube section, wherein the overlap of the inner tube sections is equal to twice the distance by which the inner tube section is desired to project beyond the edges of the corner folds and side flaps of the folded closure of the outer tube section, the succession of overlapping inner tube sections is so connected to the web of outer tube sections by transverse lines of adhesive that the transverse perforations lie centrally of the overlaps, the overlying end of each flattened inner tube section being connected to a lower face of the paper web by a line of adhesive which lies outside the region of overlap by being set back at a given spacing from the transverse perforations and being connected to an upper face of the paper web by a line of adhesive which lies within the region of overlap closely adjacent the transverse perforations whereas the underlying end of each flattened inner tube section is connected to the lower web face by a line of adhesive which lies within the region of overlap closely adjacent the transverse perforations and is connected to the upper face of the web by a line of adhesive which lies outside the region of overlap by being set back at the same said given spacing from the transverse perforations, the said given spacing being substantially equal to the amount of mutual overlap of the side flaps of the closure of the outer tube section, and wherein, during opening of the outer tube section for the purpose of forming the folded closure, a tongue defined on each projecting portion of each inner tube section by incisions is turned over through 180° about the associated set-back line of adhesive, further adhesive is applied to the margins of the still-open closure folds of the inner and outer tube sections, and the closures are then made in a manner such that the regions containing the turned-over tongues are folded over least of all.

* * * * *